United States Patent [19]

Oberhofer

[11] Patent Number: 4,681,270

[45] Date of Patent: Jul. 21, 1987

[54] MANUFACTURED REFINING ELEMENT

[75] Inventor: David P. Oberhofer, Bayside, Wis.

[73] Assignee: Sullivan Corporation, Waukesha, Wis.

[21] Appl. No.: 796,231

[22] Filed: Nov. 8, 1985

[51] Int. Cl.[4] ..... B02C 7/12

[52] U.S. Cl. ..... 241/298; 241/300

[58] Field of Search ..... 241/296, 297, 298, 300, 241/244–261.3

[56] References Cited

U.S. PATENT DOCUMENTS

| | | | |
|---|---|---|---|
| 213,175 | 3/1879 | Connett . | |
| 539,704 | 5/1895 | Pearson et al. . | |
| 942,424 | 12/1909 | Wann . | |
| 1,160,964 | 11/1915 | Warren . | |
| 1,715,772 | 8/1927 | Mechlin . | |
| 1,984,869 | 5/1931 | Farley et al. | 92/26 |
| 2,831,788 | 4/1958 | Bridge et al. | 148/10.5 |
| 3,278,127 | 10/1966 | Russell | 241/293 |
| 3,412,946 | 11/1968 | Gabler et al. | 241/293 |
| 3,614,826 | 10/1971 | Pilao | 29/434 |
| 3,745,645 | 7/1973 | Kurth et al. | 29/530 |
| 3,982,704 | 9/1976 | Palvi | 241/298 |
| 4,005,827 | 2/1977 | Frair et al. | 241/261.3 |
| 4,102,505 | 7/1978 | Sarto | 241/297 |
| 4,116,392 | 9/1978 | Zinezi | 241/296 |
| 4,157,669 | 6/1979 | Pilao | 76/101 A |
| 4,274,602 | 6/1981 | Johansson | 241/298 |
| 4,355,768 | 10/1982 | Johansson | 241/261.3 |
| 4,428,538 | 1/1984 | Valdivia | 241/298 |

*Primary Examiner*—Timothy V. Eley

*Attorney, Agent, or Firm*—Quarles & Brady

[57] ABSTRACT

A pulp refining element of the flat disk type includes a plate with an array of rectangular slots formed therein. The refining bars have tongues extending from the bottom of the bars which are received by the slots in mating engagement. The slots are arranged to align the bars in a localized pattern which is repeated about the circumference of the plate. The bars are secured onto the plate by a tack weld between the tongues and the underside of the plate.

9 Claims, 4 Drawing Figures

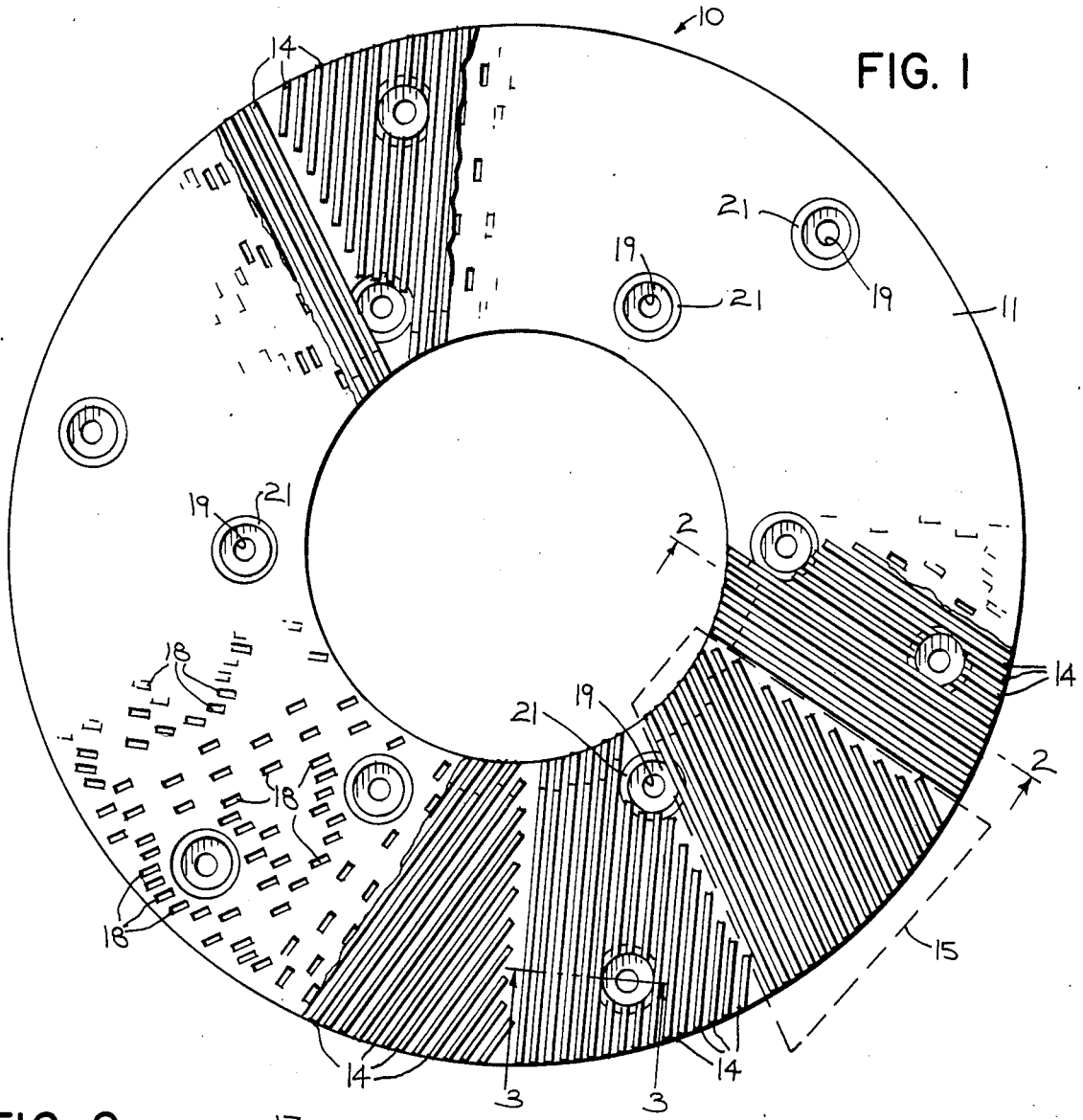
FIG. 1
FIG. 2
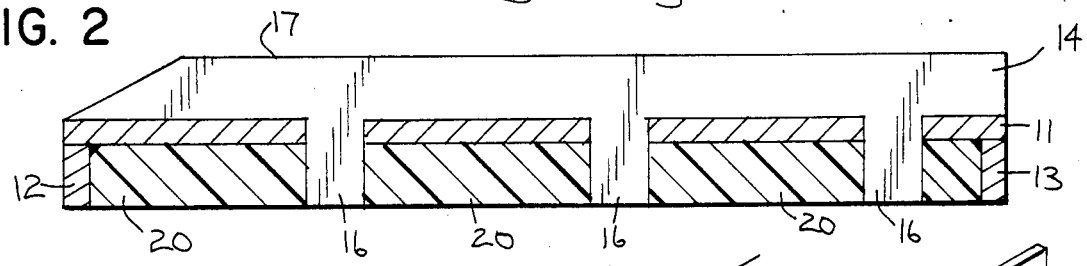
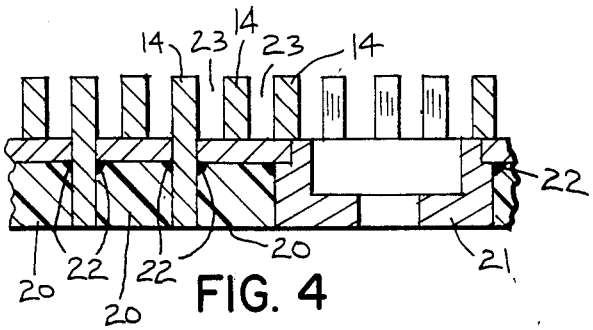
FIG. 4
FIG. 3
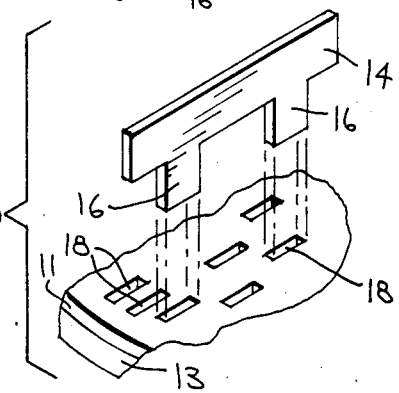

MANUFACTURED REFINING ELEMENT

BACKGROUND OF THE INVENTION

The field of this invention is pulp refining elements and the method of making same.

Pulp refining machinery utilizes rotating refining elements to condition pulp in preparation for the production of paper. The popular refining element types in use are either flat disk or conical in shape. The refining elements contain an array of closely spaced refining bars attached to a base, either disk or conical, and are used in pairs, either 2 flat disks or a male and female cone. The pulp is forced between the pair of elements where the refining bars perform the desired conditioning in well known fashion. Prior refining elements can further be classified generally as either manufactured or cast. Manufactured elements are those wherein the element is built up from individual refining bars and supporting members such as, for example, in U.S. Pat. No. 4,157,669. A cast element, on the other hand, is a one piece molding of essentially the entire element which may require some finish machine work such as, for example, in U. S. Pat. No. 3,815,834. Some elements are made in a hybrid manner as, for example, in U.S. Pat. No. 4,116,392 wherein a model of the disk is manufactured, a precision investment cast is made from the model, and the cast is then used to jig a set of manufactured bars for a cast base.

Both cast and manufactured prior elements have been expensive to make. Cast elements require less labor but are material intensive. Prior manufactured elements are highly labor intensive, such as for example in the '768 patent wherein each bar is individually jigged and hand welded into place. Further, the welding of prior manufactured elements produces excessive heat which can damage treatments performed on the refining bars for hardening. The welds of prior manufactured elements are also done on the refining side of the element where the roughness of the weld must either be machined smooth or covered with a filler to avoid interference with the refining process.

SUMMARY OF THE INVENTION

The manufactured refining element of the present invention overcomes the limitations inherent in prior elements. A refining element of the present invention includes a base with an array of rectangular slots. Each refining bar has a set of tongues which are received by the slots in mating engagement. The slots are arranged to hold the refining bars in the desired pattern. The refining bars are firmly secured in the slots by such means as, for example, a tack weld.

It is therefore an object of this invention to provide a refining element which can be inexpensively manufactured by eliminating the need for jigs and casts.

Another object of the present invention is to provide a manufactured refining element which can implement a variety of bar patterns and element types. The tongue in slot structure of the present invention is equally applicable to both flat disk and cone type refining elements. And because the slots can be located with great flexibility on the base, many varied patterns of refining bars can be achieved.

A further object of this invention is to provide a method for attaching refining bars to a refining element. The method of this invention for cutting slots in the element base and assembling and securing the tongues of the refining bars in the slots eliminates the need for time consuming jigging operations and is particularly suited to mass production techniques, such as, for example, stamping or laser cutting. And since the assembly operation is self aligning due to the tongue in slot method, assembly and the subsequent securing operations are highly suited for automation, including the use of robots, further reducing manufacturing cost.

The foregoing and other objectives and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is therefore made to the claims for interpreting the scope of the present invention.

BRIEF DESCRIPTION OF THE DRAWINGS

FIG. 1 is a plan view of a pulp refining disk which embodies the present invention;

FIG. 2 is a sectional view of the refining disk of FIG. 1 taken along line 2—2;

FIG. 3 is a perspective view of a cut out of the refining disk of FIG. 1 showing a partial assembly;

FIG. 4 is a sectional view of the refining disk of FIG. 1 taken along line 4—4.

DESCRIPTION OF THE PREFERRED EMBODIMENT

Referring to FIGS. 1 and 2, a pulp refining disk 10 includes a flat steel annular shaped plate 11 supported on the inner and outer diameter by steel annular rings 12 and 13, respectively, attached to the underside of the plate 11. On the face of the plate 11 there are attached a series of parallel steel refining bars 14 in the form of a localized pattern shown in dashed line 15. The pattern 15 is repeated at differing angular orientations around the entire circumference of the plate 11.

Each bar 14 has one or more tongues 16 extending downward from the refining surface 17, and mating into corresponding slots 18 in the plate 11. The slots 18 are arranged so as to accept the mounting tongues 16 of the refining bars 14 to achieve the desired localized pattern 15. Each refining bar 14 is designed to occupy a designated location in the localized pattern 15 and so the bar 14 dimensions as well as the number and location of the mounting tongues 16 is unique for each bar location in the pattern 15. Additionally, the plate 11 has a series of counter bore slugs 21 through which bolts (not shown) secure the disk 10 onto the refining machinery (not shown). Therefore, those bar locations in the localized pattern 15 which may fall on a counterbore slug 21 have an alternate design for the bar 14 so as to not cover the counterbore slug 21. It has been found in practice that for a 26 inch diameter plate 11 with 3/16 inch bar 14 width that an approximate spacing of 2 inches between tongues is adequate. Bars 14 shorter than approximately 4 inches need only one tongue. The tongues themselves are about ½ inch in breadth.

An epoxy filler 20 is used to encapsulate the underside of the disk to seal out contaminants.

To manufacture the refining disk 10 of the present invention, the steel plate 11 is first formed with an array of rectangular slots 18 corresponding to the ultimate positions of the refining bars 14 as described above.

Holes 19 for the grommets 21 are also formed in the plate 11 at the same time as the slots 18.

Once the plate 11 has been thus prepared with the slots 18 and holes 19, the inner and outer annular rings 12 and 13, respectively, are welded onto the underside of the plate. Grommets 21 for each hole 19 are also then welded onto the underside of the plate 11.

Referring to FIG. 3, the refining bars 14 are then inserted into the slots 18 where they are held in alignment by the slots thus negating the need for a jig or precision casting as in prior methods.

Referring to FIG. 4, once in plate, the refining bars 14 are affixed to the plate 11 by small tack welds 22 between the tongue 16 of the bar 14 and the underside of the plate 11. The tack welds 22 have been found in practice to be adequate because they function only to hold the bar 14 in the slots 18 while the side walls of the slots 18 provide the requisite strength. And since the tack welds 22 generate only a very small temperature rise in the refining bar 14 and plate 11, treatments performed on the bar 14 to harden it, as for example heat tempering or material deposition, are not degraded.

Finally, the epoxy filler 20 is poured into the underside of the disk 10 while the disk 10 is temporarily inverted.

In prior disks where the bars were welded in place from the top, the bars had to be made taller than necessary and a filling compound, such as, for example, epoxy, had to be added between the grooves between the bars to provide the required sealing. However, as shown best in FIG. 4, because of the tongue 16 in slot 18 method of fastening the bars 14 to the plate 11, the grooves 23 formed between the bars 14 are perfectly rectangular. The need for the filling compound on the refining surface 17 of the plate 11 is therefore eliminated and the refining bars 14 need only protrude a minimum height in the refining disk 10 of the present invention.

It should be apparent to one skilled in the art that the refining disk and the method of manufacture thereof of the present invention presents significant advantages in the manufacturing process which can be implemented in several different ways within the spirit of this invention. For example the plate 11 and bars 14 can easily be mass produced either by stamping or laser cutting. Also, the tongues 16 of the refining bars 14 can either be tack welded, as disclosed in this embodiment, or held in place by other means, such as, for example, by a clip (not shown) inserted through a slot (not shown) formed in the tongue 16 on the underside of the plate 11. Because of the self aligning bars, the method of the present invention is also advantageous in that it enables the manufacturing process to be automated, including the use of robots for assembly and securing operations. And finally, it should be apparent that the tongue and slot method used in the present invention is adaptable to a wide variety of bar patterns and even to other types of refining elements, such as, for example, conical refining elements and therefore this invention is not restricted to the specific pattern and type of element shown in this embodiment.

I claim:

1. A manufactured refining element comprising:

a base having formed therein a plurality of slots, a plurality of refining bars, each bar having at least one tongue wherein the tongue of each refining bar is received in one of the slots in mating engagement and extends from a topside of the base, through the base, to an underside of the base and the slots are arranged to hold the refining bars in a predetermined pattern; and securing means connected to each tongue or the underside of the base for holding.

2. The refining element of claim 2 wherein the base is an annular shaped plate.

3. The refining element of claim 2 further comprising mounting grommets on the face of the plate.

4. The refining element of claim 3 in which the predetermined pattern of the refining bars allows access to the grommets from the topside of the base.

5. The refining element of claim 2 wherein said predetermined pattern comprises a localized pattern of refining bars which is repeated in regular fashion around the circumference of the element.

6. The refining element of claim 5 wherein each refining bar of the localized pattern has a unique predetermined shape.

7. The refining element of claim 2 further comprising inner and outer annular rings bonded to the underside of the plate, thereby defining a cavity on the underside of the plate.

8. The refining element of claim 7 further comprising a filling compound encapsulating the cavity on the underside of the element.

9. The refining element of claim 1 wherein said securing means is a tack weld applied on the underside of the base between the tongue of each of said plurality of refining bars and the base.

* * * * *

UNITED STATES PATENT AND TRADEMARK OFFICE

CERTIFICATE OF CORRECTION

PATENT NO. : 4,681,270

DATED : July 21, 1987

INVENTOR(S) : David P. Oberhofer

It is certified that error appears in the above—identified patent and that said Letters Patent is hereby corrected as shown below:

Column 3, line 12, change "once in plate" to --once in place--.

Claim 1, column 4, line 22, change "or the underside of the base for holding" to --on the underside of the base for holding the refining bars firmly in the slots--.

Claim 2, column 4, line 24, change "of claim 2" to --of claim 1--.

Signed and Sealed this

Seventeenth Day of November, 1987

*Attest:*

*Attesting Officer*

DONALD J. QUIGG

*Commissioner of Patents and Trademarks*